United States Patent [19]

Arai

[11] Patent Number: 4,707,154

[45] Date of Patent: Nov. 17, 1987

[54] PRINTER

[75] Inventor: Kenichiro Arai, Shiojiri, Japan

[73] Assignee: Seiko Epson Kabushiki Kaisha, Japan

[21] Appl. No.: 943,889

[22] Filed: Dec. 19, 1986

Related U.S. Application Data

[63] Continuation of Ser. No. 686,351, Dec. 26, 1984, abandoned.

[30] Foreign Application Priority Data

Dec. 27, 1983 [JP] Japan ..... 58-251589

[51] Int. Cl.[4] ..... B41J 23/34; B41J 3/20

[52] U.S. Cl. ..... 400/185; 400/120; 192/28

[58] Field of Search ..... 400/120, 185, 187, 377, 400/378; 192/28, 33 R, 71

[56] References Cited

U.S. PATENT DOCUMENTS

| | | | |
|---|---|---|---|
| 1,585,996 | 5/1926 | Kohman | 192/28 |
| 2,564,324 | 8/1951 | Colman | 192/28 |
| 2,566,540 | 9/1951 | Steed | 192/28 |
| 4,458,253 | 7/1984 | Goff, Jr. et al. | 400/120 X |

FOREIGN PATENT DOCUMENTS

| | | | |
|---|---|---|---|
| 30882 | 3/1981 | Japan | 101/93.21 |

*Primary Examiner*—Charles A. Pearson
*Attorney, Agent, or Firm*—Blum Kaplan

[57] ABSTRACT

A printer and in particular a printer adapted for use with a thermal print head is provided. The printer includes a power transmission which controls two clutches with a single electromagnetic driving unit. A clutch of a power transmission is initialized without the use of a detector by dividing the perimeter of the clutch into N equal rotating angles each equal rotating angle being further subdivided into a large rotating angle and a small rotating angle in combination with a preselected energization period for an electromagnetic control member which assures the initialization of the clutch in a desired position. The clutch is advanced one position by a second energization period of the electromagnetic control member. The carriage mover of the printer allows the carriage to reciprocate in response to forward and backward rotation of a shifting shaft and at at least one end of the range of motion of the carriage the shifting shaft can continue to freely rotate even though the carriage cannot. The ribbon movement mechanism for a thermal printer only advances the ribbon when a character is to be printed by only rotating a gear member which selectively engages a rack on the printer case.

11 Claims, 18 Drawing Figures

PRINTER

This is a continuation of application Ser. No. 686,351, filed Dec. 26, 1984, now abandoned.

BACKGROUND OF THE INVENTION

The invention is generally directed to an electronic printer and in particular to various subsystems of a printer including the power transmission, clutch initialization system, head movement and ribbon movement mechanisms.

Although a variety of mechanisms have been used to transmit or interrupt motive power utilizing clutches most utilize a plurality of clutches where each clutch is controlled by a corresponding electromagnetic member. The electromagnetic members have the largest number of parts, are most expensive and occupy the largest space among the components utilized in a printer. As a result, in multiclutch power transmissions for printers, bulkiness and expense have proved troublesome, particularly in the development of portable and inexpensive printers. Accordingly, there is a need for a power transmission for a printer which reduces the need for an electromagnetic member for each clutch. It is specifically desired to provide a power transmission for a printer which controls power transmission with two clutches but only one electromagnetic member by making use of both the forward and backward rotation of the motor.

The invention is also generally directed to a power transmission apparatus in which the printer can be initialized in a desired standby position by using a clutch which can restrain the rotating angle of the clutch to less than one full rotation. In printers using a clutch able to set the rotating angle at less than one full rotation it has been usual to connect a detector at the output side of the clutch corresponding to the divisions of the perimeter of the clutch. For example, a cam is connected to show the corresponding position of the clutch. However, when the printer or other apparatus is started it is necessary to check the stopped position (i.e., phase on the output side) of the clutch which has been divided into several parts. As a result, a detector provided on the output side of the apparatus to detect the phase of the stopping position of the clutch was required. The apparatus therefore has an increased size and cost, because of the additional parts required. Also, the reliability of the detector varies depending upon its complexity and design. The need for a detector to establish the stopped position of the clutch is inconvenient in an apparatus such as a portable and inexpensive printer. Accordingly, there is a need for a clutch initalization mechanism which eliminates the need for a detector and which places the clutch in a desired standby position without the need to first check the positioning of the clutch.

The invention is also directed to a carriage movement mechanism for a printer which moves the carriage by the engagement of a carriage shifting cam on the carriage with a plurality of shifting pins along the range of movement of a carriage. Various arrangements of shifting cam members and shifting pins have been used to shift the printer carriage. However, a problem with these devices is the locking of the shifting cam and attached shifting shaft at both ends of the movable range of the carriage. This results in unacceptable forces being applied to the mechanism.

As an attempt to overcome this problem another approach has been tried which provides a region between the point at which the carriage stops and the position at which it locks. A second proposed solution was to remove the pins on both ends of the movable range to disengage the shifting cam from the pins on the ends. In these situations the whole carriage is pushed to an engaged side with a pin by a spring or other biasing device to re-engage. However, the rotation of the shifting shaft to which the shifting cam is coupled cannot be utilized for other operations. In the first attempted solution the total number of revolutions of the shifting shaft is limited by the range between the end of the pins and the locking position. In the second attempt to solve the problem a large spring is necessary to move the entire carriage which increases the vibration and noise to a level that is unacceptable for use in a low-noise printer such as a thermal printer. Accordingly, a carriage movement mechanism which allows for the continuous rotation of the shifting shaft with low vibration and noise is desired.

The invention is also directed to a thermal print ribbon movement mechanism which prevents the advance of the thermal print ribbon when no characters are printed. Ribbon take-up mechanisms for thermal printers using thermal ribbons and in particular thermal ribbons mounted on a carriage have had take-up of the ribbon controlled by a take-up motor or other power device. In other approaches the take-up mechanism achieves its power by converting a force in the direction of carriage movement into a turning force by the combination of a rack and pinion, friction plate and friction wheel. The take-up of the thermal ribbon is controlled by adjusting the engagement between the rack and pinion or friction plate and friction wheel by rotation of the entire carriage. The first approach requires a motor or other power source exclusively devoted to the take-up of the ribbon, which is expensive and occupies significant amounts of space. In the second approach a large force is required to rotate the entire carriage and a complicated mechanism unavoidably results. In addition, the printer dimensions must be enlarged so that the carriage is free to rotate within the case. Accordingly, there is a need for a thermal print ribbon movement mechanism which does not require the need for an additional power source or require the rotation of the carriage.

SUMMARY OF THE INVENTION

Generally speaking, in accordance with the invention, a power transmission for a printer is provided. The new printer includes a motor rotatable in a forward and reverse direction, first and second clutches coupled to the motor and a locking member for locking one of the first and the second clutches. A locking controller causes the locking member to lock the second clutch when the motor is rotating in the forwrad direction and to lock the first clutch when the motor is rotating in the reverse direction. A controlling member controls the movement of the first and second clutches and an electromagnetic driver drives the controlling member.

In addition, a clutch initializer for a power transmission is provided. The clutch initializer includes a clutch rotatably mounted to a power transmission. The perimeter of the clutch is divided into N equal rotating angles (N=to a positive integer). Each of the N rotating angles are further divided into a large rotating angle and a small rotating angle. The sum of the large rotating angle and the small rotating angle equals the rotating angle. A controlling member is selectively coupled to the clutch for controlling the rotation of the clutch. An electromagnetic control member coupled to the controlling member decouples the controlling member from the clutch thereby allowing the clutch to rotate during an energization period. The electromagnetic control member recouples the controlling member with the clutch after the energization period, thereby preventing further rotation of the clutch. A printing member, coupled to the clutch has a printing position and a non-printing position. As a result, the printing member is established in the non-printing position when the electromagnetic control member is energized for a period longer than the time for the clutch to rotate through the small rotating angle and shorter than the time for the clutch to rotate through the large rotating angle.

In addition, a carriage mover for a printer is provided. The carriage mover includes a pair of frames in spaced separation and a carriage slidably movable in a range between the frames. A shifting shaft is rotatably mounted between the pair of frames. A worm member is coupled to the shifting shaft for slidable displacement therealong and rotation therewith. The carriage is mounted across the worm member so that the carriage moves in synchronization with the worm member. Pin members interact with the worm member and cause the worm member to slidably reciprocate along the shifting shaft in response to the forward and backward rotation of the shifting shaft. The pin members extend over a substantial portion of the range of motion of the carriage. A shifting engagement member selectively engages with the worm member in the portion of the range of motion of the carriage not covered by the pin members.

Also, a ribbon movement mechanism for a thermal printer having a case, movable carriage, print head and ribbon coupled to a take-up gear is provided. The ribbon movement mechanism includes a gear member rotatably mounted on the movable carriage having a first arm, second arm and interlocking first and second gears. The second gear is coupled to the take-up gear. A biasing member coupled to the first arm biases the gearing member is a first direction. A head position member contacts the second arm for pivoting the gear member in a second direction, opposite to the first direction when the print head is in a non-printing position. A rack, coupled to the case, is adapted to engage the second gear when the gear member is rotated in the first direction. The rack does not engage the second gear when the gear member is pivoted in the second direction. As a result, the ribbon cartridge is only advanced when the second gear is engaged with the rack and the carriage, on which the gear means is mounted, moves with respect to the case.

Accordingly, it is an object of the instant invention to provide an improved printer.

Another object of the invention is to provide an improved power transmission for a printer in which two clutches are controlled by only one electromagnetic member.

A further object of the invention is to provide an improved printer which allows for the use of only a single electromagnetic member to control two clutches by utilizing a locking member and a control member and opposing rotational directions of a motor.

Still another object of the invention is to provide a printer using only one electromagnetic member so as to form a small and light printer.

Yet a further object of the invention is to provide a portable printer by eliminating an electromagnetic member by controlling two clutches with a single electromagnetic member.

Yet another object of the invention is to provide an improved carriage movement mechanism for a printer.

Still a further object of the invention is to provide a carriage movement mechanism for a printer which allows continuous rotation of the shifting shaft with extremely low vibration and noise.

Yet another object of the invention is to provide a carriage movement mechanism for a printer with simplified structure and lightweight parts by utilizing a shifting cam and shifting pins which are disengaged at the end of the movement range of the carriage and utilizes an auxiliary pin which engages with the shifting cam for reengagement of the shifting pins for reverse movement of the carriage.

Still a further object of the invention is to provide an improved carriage movement mechanism for a printer which decreases the size and weight of the carriage movement mechanism so that the mechanism may be used in a lightweight portable printer.

A further object of the invention is to provide an improved ribbon advancement mechanism for a thermal printer which only advances the ribbon when a character is to be printed.

Still another object of the invention is to provide an improved cartridge advancement mechanism for a thermal printer which is compact and lightweight.

Yet still another object of the invention is to provide a ribbon advancement mechanism for a thermal printer which obviates the need for an additional motor or the rotation of the entire carriage.

Still a further object of the invention is to provide a ribbon cartridge advancement mechanism for a thermal printer which utilizes a rack and pinion as a take-up driving source for the thermal print ribbon.

Another object of the invention is to provide a small, inexpensive and low power consuming thermal transfer printer which controls the movement of the thermal print ribbon with only limited energy requirements.

Yet another object of the invention is to provide a clutch initialization mechanism for a clutch driven apparatus.

A further object of the invention is to provide a clutch initialization mechanism for a printer.

Another object of the invention is to provide a clutch initialization mechanism for a power transmission apparatus in which the clutch can be set in a desired standby position without the need for a detector.

Yet a further object of the invention is to provide a clutch initialization mechanism for a power transmission of a printer wherein the clutch can be stopped at a given standby position as a result of the combination of the division of the perimeter of the clutch and the variation of the energization period of an electromagnetic control member.

Yet another object of the invention is to provide a printer which can be set in a desired standby position without the need for a detector on the output side of the clutch.

Still a further object of the invention is to provide a power transmission for a printer which initializes the printer into a desired starting position without the need for a detector.

A further object of the invention is to provide a portable printer without the need for a detector as a result of a clutch initializer which presets the position of the clutch to a desired standby position.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
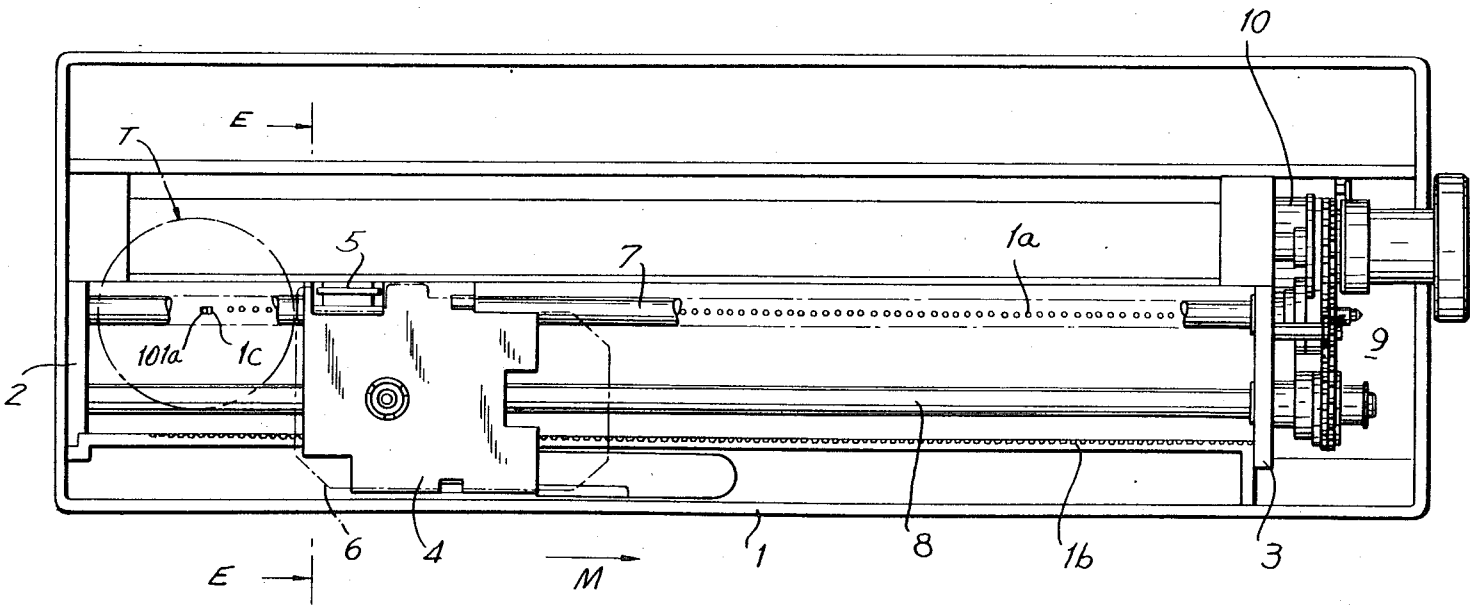
FIG. 1 is a top plan view of a thermal transfer printer constructed in accordance with a preferred embodiment of the invention.

Reference is made to FIG. 1 wherein a top plan view of a portable thermal transfer printer with the upper case of the printer removed, constructed in accordance with the invention, is depicted. A case 1 for the printer also serves as the main frame. Side frames 2 and 3 are mounted on case 1. A carriage 4 has a thermal print head 5 and a ribbon cassette 6 mounted thereto. Carriage 4 is slidably mounted and guided by a shifting shaft 7 and a head cam shaft 8 in the axial direction of shifting shaft 7 and head cam shaft 8. Shifting shaft 7 and head cam shaft 8 are rotatably mounted to side frames 2 and 3. A power transmission mechanism 9 selectively transfers the rotational movement of a motor 11 (FIG. 3), to shifting shaft 7, head cam shaft 8 and a paper feeding shaft 10.

Figure 3:
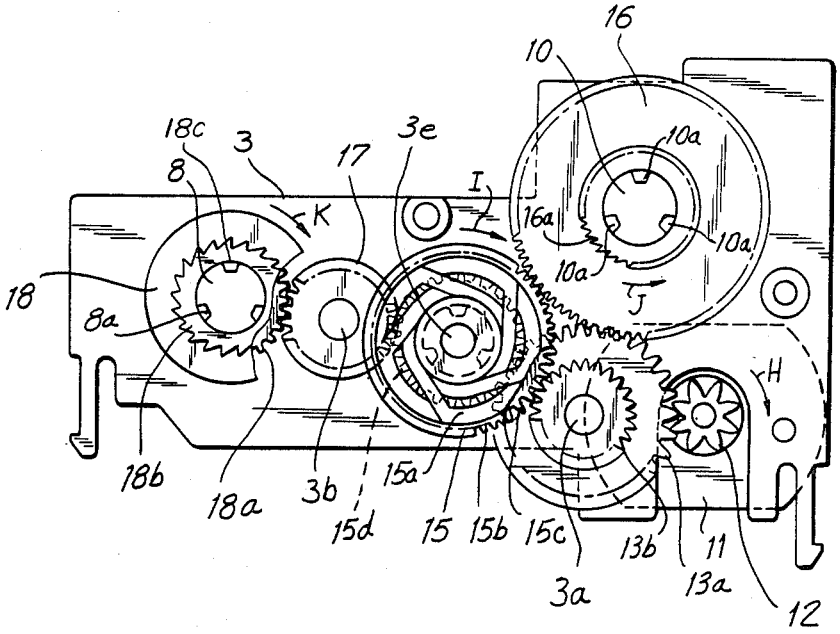
FIG. 3 is a partially cut-away side elevational view of a gear train of the power transmission mechanism of FIG. 2.
Figure 4:
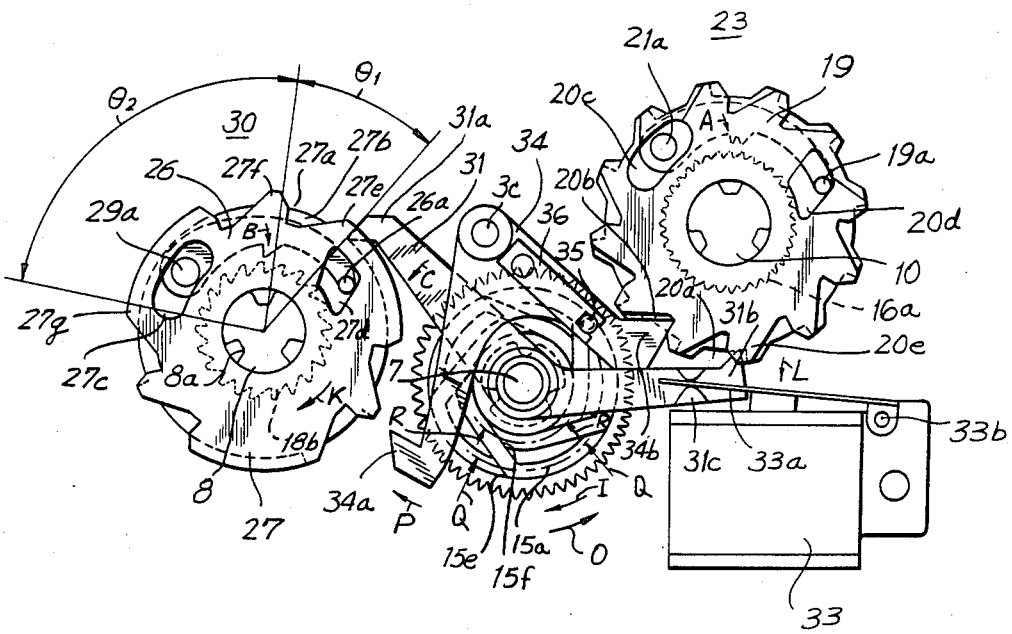
FIG. 4 is a side elevational view of the power transmission mechanism of FIG. 2 in a first state.
Figure 11A:
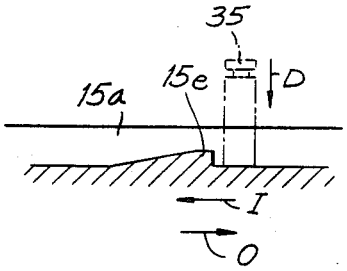
FIG. 11A is a cross-sectional view taken along line Q—Q of FIG. 4.
Figure 11B:
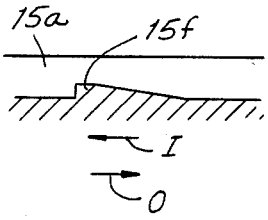
FIG. 11B is a cross-sectional view taken along line R—R of FIG. 4.

The rotation of a motor 11, fixed to side frame 3 (FIG. 3), is transmitted to a shifting gear 15 through a motor gear 12 mounted on motor 11 and reduction gears 13*a* and 13*b* rotatably mounted on shaft 3*a* of side frame 3. Shifting gear 15 is journalled on shaft 3*e* formed integrally with side frame 3. Shifting gear 15 has a grooved cam 15*a* provided at the end face thereof with three grooves. A gear 15*b* around the perimeter of shifting gear 15 engages with a paper feeding clutch gear 16. A gear wheel 15*c* engages with reduction gear 13*b*. A gear 15*d*, also formed on shifting gear 15, engages with a transmission gear 17 journalled on a shaft 3*b* formed integrally with side frame 3. Cross-sectional views of end face cam 15*a* taken along lines Q—Q and R—R in FIG. 4 are shown in FIGS. 11A and 11B, respectively.

Figure 2:
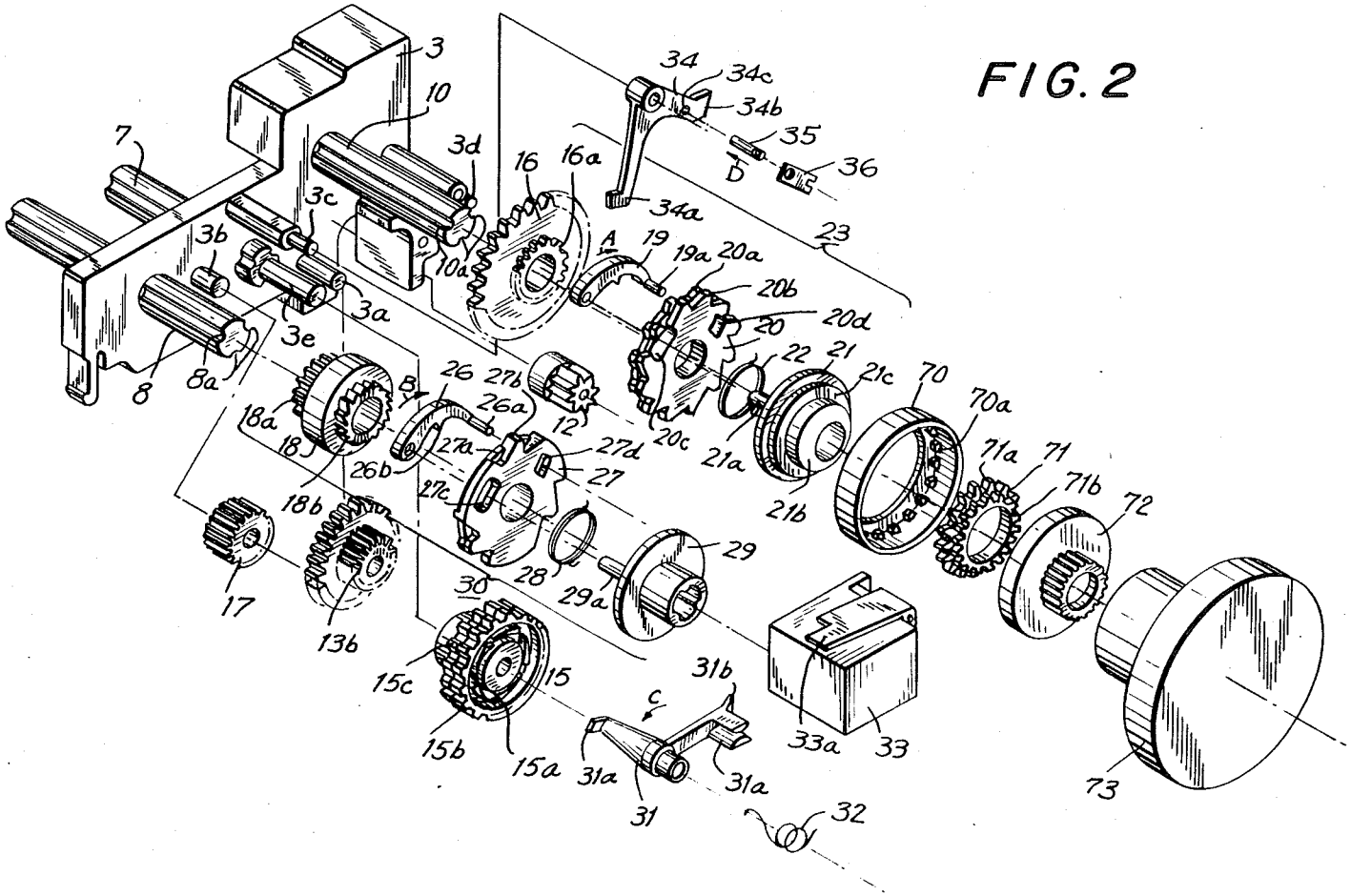
FIG. 2 is an exploded perspective view of a power transmission mechanism constructed in accordance with the invention.

Paper feeding clutch gear 16 is integrally formed with a ratchet wheel 16*a* which engages with a paper feeding clutch pawl 19 secured to a shaft 21*a* of a driving plate 21. Paper feeding clutch plate 20 has two types of cutouts, 20*a* and 20*b* about its perimeter which are arranged so as to divide the respective outer perimeter into twelve equal parts. Shaft 21*a* of driving plate 21 projects into an aperture 20*c* formed in paper feeding clutch plate 20. A paper feeding clutch spring 22 has one end fixed to paper feeding drive plate 21 and the other end attached to a shaft 19*a* integrally formed with paper feeding clutch pawl 19 and projecting outwardly therefrom into an aperture 20*d* formed in clutch plate 20. As a result, paper feeding clutch pawl 19 is biased in the direction of arrow A (FIG. 2). Paper feeding clutch gear 16, paper feeding clutch plate 20 and paper feeding drive plate 21 are journalled to paper feeding shaft 10, which has three grooves 10*a* on the outer periphery thereof. A first clutch (paper feeding clutch) 23 is composed of paper feeding clutch gear 16, paper feeding clutch pawl 19, paper feeding clutch plate 20, paper feeding clutch spring 22 and paper feeding drive plate 21.

Paper feeding drive plate 21 is integrally formed with a shaft 21c which has a paper feeding transmission gear 70 rigidly fitted thereto. Paper feeding transmission gear 70 has an internal gear 70*a*. Paper feeding drive plate 21 also has an eccentric shaft 21*b* integrally formed and extending thereform. A paper feeding transmission gear 71 is tightly fitted to shaft 21*b*. Paper feeding transmission gear 70 can be prevented from rotating by means of a pin 3d integrally formed on and extending outward from side frame 3. A paper feeding gear 72 has an internal gear (not visible in FIG. 2) which engages with a gear 71*b* of paper feeding transmission gear 71 and is non-rotatably fixed to paper feeding shaft 10. Paper feeding gear 72 is rigidly coupled to shaft 10 so that gear 72 and shaft 10 rotate together. Eccentric shaft 21*b* of paper feeding driving plate 21, paper feeding transmission gears 70 and 71 and paper feeding gear 72 form a reduction mechanism. A paper feeding knob 73 is coupled to paper feeding gear 72 through a slippage clutch which stops transmitting torque when the load applied to the slippage clutch exceeds a certain level.

A head cam gear 18 is slidably and non-rotatably secured to head cam shaft 8 which has three grooves 8*a* on the outer periphery thereof. Head cam gear 18 also has a gear 18*a*, a ratchet wheel 18*b* and three ridges 18*c* adapted to engage grooves 8*a*. A head clutch plate 27 is formed with two types of cutouts 27*a* and 27*b* formed on the outer periphery thereof. In addition head clutch plate 27 has apertures 27*c* and 27*d* through its interior. Head clutch plate 27 is securely fitted to head cam shaft 8. A head cam driving plate 29 is non-rotatably fixed to head cam shaft 8. Head cam driving plate 29 has an eccentric shaft 29*a* projecting through aperture 27*c* formed in head clutch plate 27. A head clutch pawl 26, having a projection pin 26*a*, engages with ratchet wheel 28*b* and is also rigidly fitted to shaft 29*a* of head cam driving plate 29. Cutouts 27*a* and 27*b* of head clutch plate 27 are arranged so as to divide the outer circumference of head clutch plate 27 into three equal parts, each of which is unequally divided into two ranges corresponding to a small rotating angle $\theta_1$ (defined by projections 27*e* and 27*f*) and a large rotating angle $\theta_2$ (defined by projections 27*f* and 27*g*) (FIG. 4). A head clutch spring 28 has one end fixed to head cam driving plate 29 and the other end attached to a shaft 26*a* integrally formed and extending outwardly from head clutch pawl 26 which projects through aperture 27*d* in head clutch plate 27. As a result, head clutch pawl 26 is urged in the direction of arrow B.

A second clutch (head cam clutch), generally indicated as 30, is composed of head clutch gear 18, head clutch pawl 26, head clutch plate 27, head clutch pawl spring 28 and head cam driving plate 29. A trigger lever 31 serves as a control member. One end 31*a* thereof engages cutout 27*a* of head clutch plate 27. The other end 31*b* of trigger lever 31, engages cutout 20*a* of paper feeding clutch 20. Trigger lever 31 is rigidly fitted to shifting shaft 7 and is urged in the direction of arrow C by a spring 32.

An electromagnet 33 is fixed to side frame 3. Electromagnet 33 has an attracting iron plate 33*a* which is coupled to clip 31*c* of trigger lever 31.

A switching lever 34 serves as a locking member. Switching lever 34 is securely fitted to shaft 3*c* on side frame 3. Switching lever 34 has one end 34*a* engaging cutout region 27*d* of head clutch plate 27. The other end 34*b* of switching lever 34 engages with cutout region 20*b* of paper feeding clutch plate 20. A switching pin 35 is inserted in an aperture 34*c* of switching lever 34 and switching pin 35 is urged in the direction of arrow D (FIG. 2) by means of a leaf spring 36 fixed to switching lever 34. Switching pin 35 engages end face cam 15*a* of shifting gear 15 and serves as a locking control member.

Figure 7:
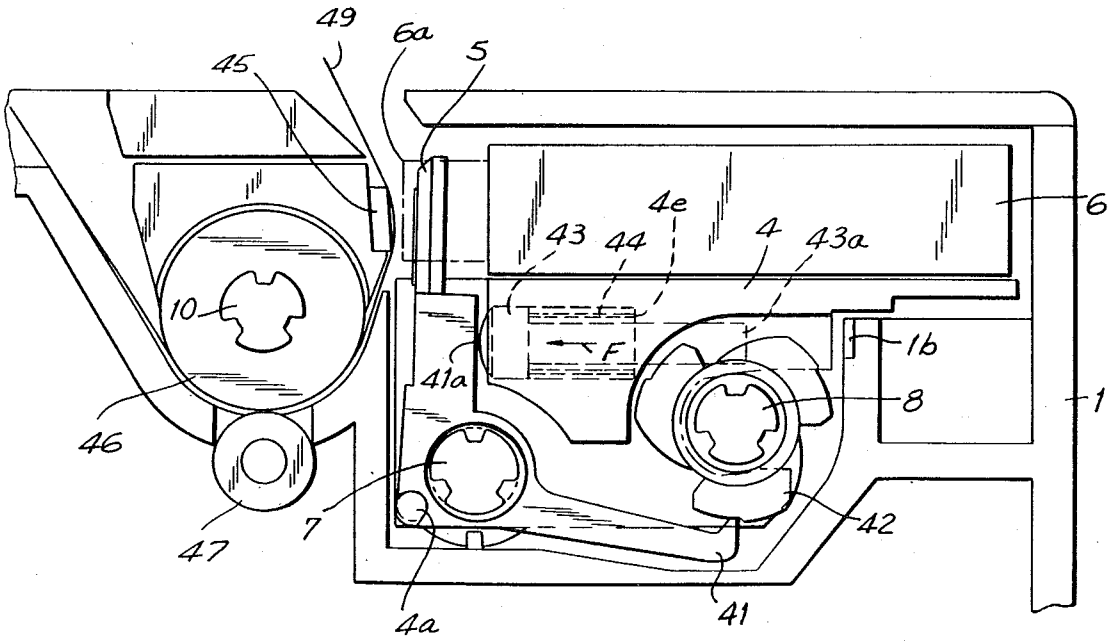
FIG. 7 is a cross-sectional view taken along line E—E of FIG. 1 in a non-printing position.
Figure 8:
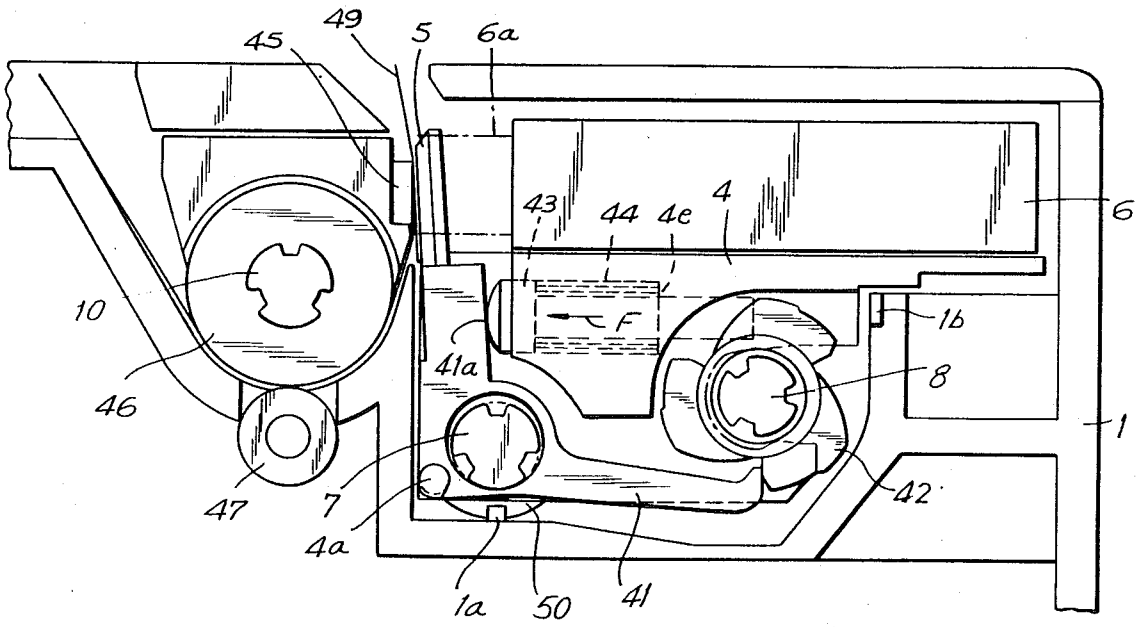
FIG. 8 is a cross-sectional view taken along line E—E of FIG. 1 in a printing position.
Figure 9:
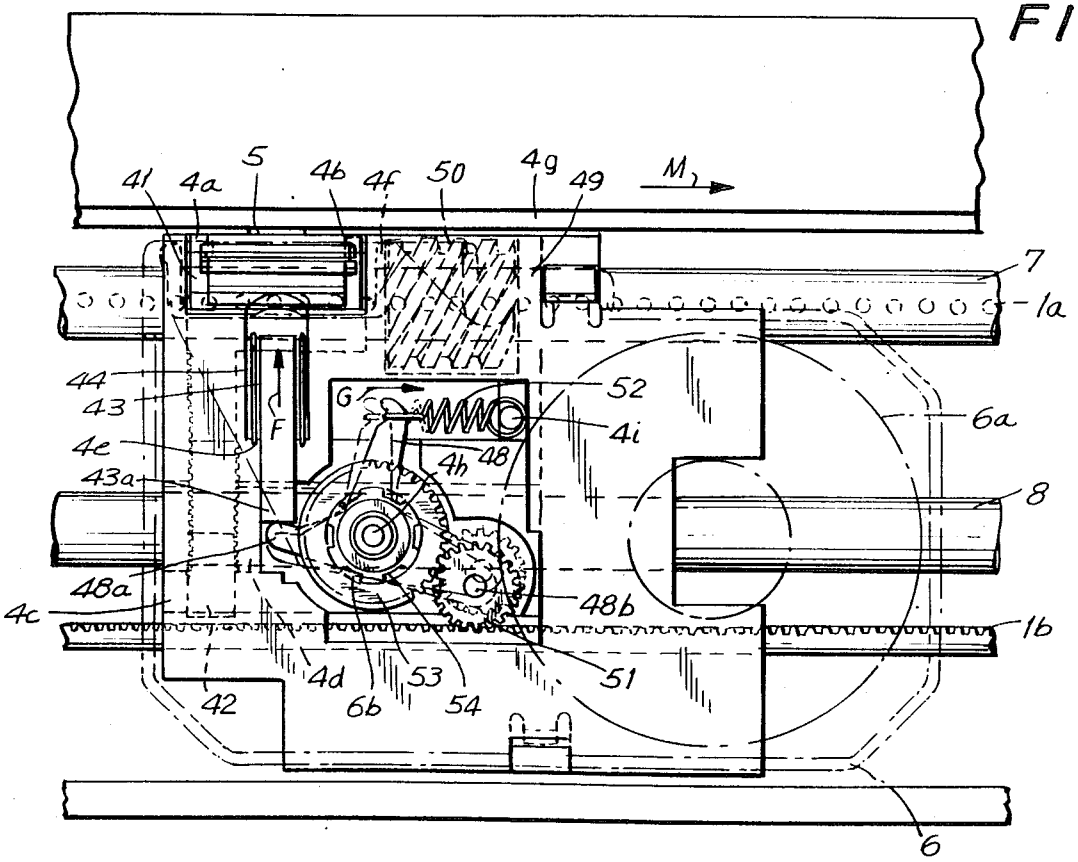
FIG. 9 is a top plan view of a carriage constructed in accordance with a preferred embodiment of the invention in which an engaged and a disengaged position of a winding drive gear are depicted.

Reference is next made to FIGS. 7, 8 and 9 wherein the manner of operation of a head 5 is depicted. In this embodiment head 5 is a thermal print head. A head lever 41 has a thermal head 5 mounted thereto. Head lever 41 is securely fitted to pins 4*a* and 4*b* of carriage 4 (see FIG. 9) and a head cam 42, which is held between arms 4*c* and 4*d* of carriage 4. Head cam 42 is slidably fitted on cam shaft 8. Head cam 42 does not rotate independently of cam shaft 8. Head cam 42 has a cam portion on the outer periphery thereof and the cam portion engages head lever 41. A head pushing rod 43, mounted to carriage 4, slidable parallel to the direction of arrow F, is biased in the direction of arrow F (FIGS. 7–9) by a compression spring 44 received in a part 4*e* of carriage 4. One end of head pushing rod 43 engages portion 41*a* of head lever 41. The other end of rod 43 engages a part 48*a* of a winding lever 48 (FIG. 9). Head 5 is pushed against a platen sheet 45 through a thermal ribbon 6*a* and a printing paper 49.

A paper feeding roller 46 is fixed to paper feeding shaft 10. A paper holding roller 47 presses against paper feeding roller 46 through printing paper 49. A shifting worm 50, is held between arms 4*f* and 4*g* of carriage 4. Worm 50 is slidably but not rotatably fitted to shifting shaft 7 with interlocking grooves 7*a* and ridges 50*a*. Shifting worm 50 engages with shifting pins 1*a* integrally formed with case 1. Winding lever 48 is securely fitted to a shaft 4*h* of carriage 4 and is biased in the direction of arrow G by a spring 52 which is coupled between winding lever 48 and a pin 4*i* integrally formed and extending outward from carriage 4. A winding drive gear 51 engages with a rack 1*b* formed on case 1. Winding drive gear 51 is securely journalled to a shaft 48*b* extending from winding lever 48. A winding gear 53 engages with winding drive gear 51 and is journalled to shaft 4*h*. Winding gear 53 has projections on its interior which frictionally engage with a winding shaft 54. Winding shaft 54 is engaged with a winding hub 6*b* for which advances thermal ribbon 6*a*.

A description of the manner in which the printer, constructed in accordance with the preferred embodiment described above operates, follows. The initial setting, printing process, paper feeding and carriage returning process and the printing and paper feeding subsequent to the second line are now each described in greater detail.

1. INITIAL SETTING

When motor 11 is turned on and rotates motor gear 12 in the direction of arrow H, other gears are also rotated. The rotation of gear 12 causes the rotation of reduction gears 13*a* and 13*b*, shifting gear 15, paper feeding clutch gear 16, transmission gear 17 and head clutch gear 18. The rotation of motor 11 in the direction indicated by arrow H causes shifting gear 15, paper feeding clutch gear 16 and head clutch gear 18 to rotate in the directions indicated by arrows I, J and K, respectively (FIG. 3).

Figure 10:
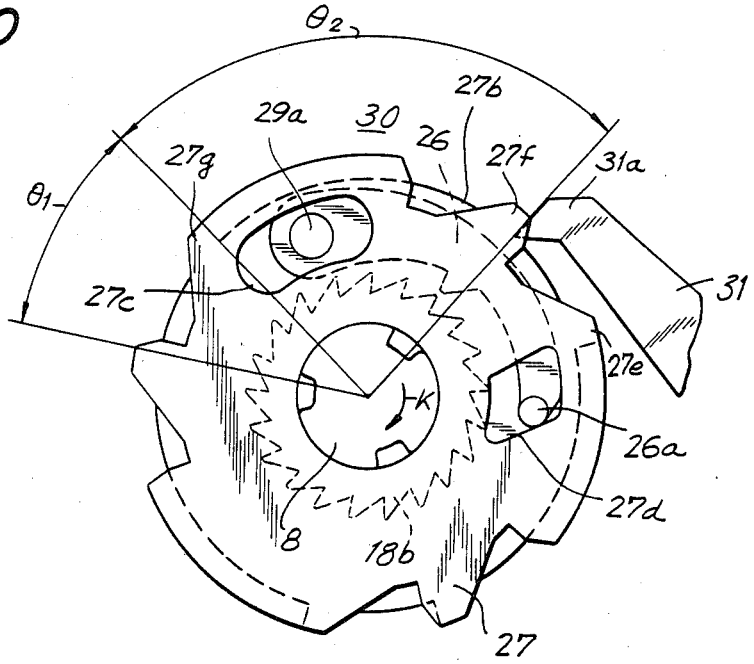
FIG. 10 is a side elevational view of a head cam clutch for the power transmission mechanism of FIG. 2.

Reference is next made to FIG. 4 wherein it is seen that the rotation of shifting gear 15 in the direction of arrow I causes part 34*b* of switching lever 34 to engage with cutout 20*b* of paper feeding clutch plate 20. As a result, paper feeding clutch plate 20 is locked in place. In the initial or starting state, when head clutch plate 27 is in the standby state, part 31*a* of trigger lever 31 may be in one of two possible positions. It may be engaged with cutout 27*a* at the right end of the range corresponding to small rotating angle $\theta_1$ (FIG. 4) or it may at the right end of the range corresponding to large rotating angle $\theta_2$ (FIG. 10).

The standby position of head clutch plate 27 depicted in FIG. 4 corresponds to the position of head cam 42 depicted in FIG. 7. In this position thermal head 5 is not in contact with paper 49 or platen sheet 45. This position will be referred to as the non-printing position. The standby position of head clutch plate 27 shown in FIG. 10 corresponds to the phase of head cam 42 shown in FIG. 8, that is where thermal head 5 is pressed against platen sheet 45 (hereinafter referred to as the printing position). For normal printing operation thermal head 5 must initially be removed from platen sheet 45 as shown in FIG. 7.

Figure 5:
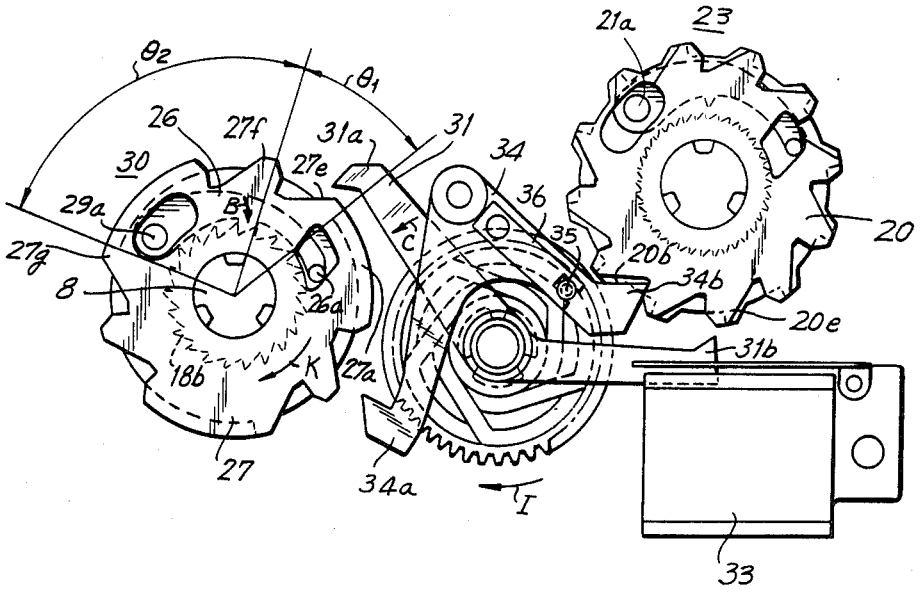
FIG. 5 is a side elevational view of the power transmission mechanism of FIG. 2 in a second state.

Reference is next made to FIG. 4 wherein the functioning of clutches 23 and 30 is depicted. When electromagnet 33 is energized, attracting iron plate 33*a* is rotated about pin 33*b* in the direction of arrow L. Plate 33*a* is firmly coupled to clip 31*c* of trigger lever 31. As a result, when plate 33*a* rotates in the direction of arrow L trigger lever 31 is rotated in a direction opposite to the direction of arrow C. This results in part 31a of trigger lever 31 disengaging from projection 27*e* of head clutch plate 27 and part 31*b* disengaging from projection 20*e* of paper feeding clutch plate 20 (FIG. 5). When head clutch plate 27 ceases to be locked by trigger lever 31, head clutch pawl 26 rotates in the direction of arrow B (FIG. 3) while part 26*a* of clutch pawl 26 rotates in the direction of arrow K as a result of the biasing provided by head clutch spring 28. As part 26*a* rotates in the direction of arrow K a tooth 26*b* on the bottom surface of clutch pawl 26 engages with head clutch ratchet wheel 18*b* to transmit the rotation of head clutch ratchet wheel 18*b* to head cam driving plate 29 and head cam shaft 8 through pin 29*a*.

If the energization time of electromagnet 33 is set longer than the time required for a rotation of head clutch plate 27 through small rotating angle $\theta_1$ (hereafter referred to as the rotation time for small rotating angle $\theta_1$), but shorter than the time required for head clutch plate 27 to rotate through the large rotating angle $\theta_2$ (hereafter referred to as the rotation time for large rotating angle $\theta_2$), trigger lever 31 returns to its standby state after projection 27*f* of head clutch plate 27 passes part 31*a* of trigger lever 31 but before projection 27*g* reaches part 31*a*. Part 31*a* locks projection 27*g*, stopping the rotation of head clutch plate 27. Trigger lever 31 is then biased into the standby position by spring 32. When head clutch plate 27 stops rotating, head clutch pawl 26, and in particular tooth 26*b*, disengages from head clutch ratchet wheel 18*b*. As a result, the rotation of head cam driving plate 27 and head cam shaft 8 are stopped.

As can be seen in FIG. 4, the sum of $\theta_1$ and $\theta_2$ is 120°, or Δ of a complete circle. As described above, head clutch plate 27 is positioned at the right end of the range corresponding to small rotating angle $\theta_1$ in FIG. 4 after the energization of electromagnet 33. In this position thermal head 5 is in the desired non-printing position (as shown in FIG. 7).

The second possibility is that the printer mechanism is resting in the second standby position prior to initialization. Here, head clutch plate 27 is locked at the right end of the range corresponding to large rotating angle $\theta_2$ (FIG. 10). Trigger lever 31 rotates when electromagnet 33 is energized. As a result, part 31*a* is released from projection 27*f* of head clutch plate 27. Head clutch 30 rotates in the direction of arrow K. The energization time of electromagnet 33 is set to a period shorter than the rotation time for large rotating angle $\theta_2$. Therefore, trigger lever 31*a* returns to its standby state before projection 27*g* of head clutch plate 27 passes it. As a result, projection 27*g* is locked by part 31*a*, stopping the rotation of head clutch plate 27 and the resultant transmission of torque to head cam shaft 8. This sequence of events causes head clutch plate 27 to be set at the right end of the range corresponding to small rotating angle $\theta_1$ in FIG. 4 and thermal head 5 is again set in the desired non-printing position (FIG. 7).

As described above, thermal head 5 can be set in the desired non-printing position, no matter which of the standby positions (FIG. 4 or FIG. 7), thermal head 5 began in. The result of the ability to set the printer head in a uniform position, away from platen sheet 45, which is required before printing can be done, by merely providing a pulse of a predetermined duration is of great value. This obviates the need to determine the position of the thermal head or of head clutch plate 27 to initialize the printer head for the start of printing.

By the above described construction it becomes possible to always set thermal head 5 in a position away from platen head 45 (non-printing position), by dividing the periphery of head clutch plate 27 into unequal arcs and utilizing an initial setting energization time longer than the rotation time for small angle $\theta_1$ but shorter than the rotation time for $\theta_2$. It is noted that in this case the circumference of head clutch plate 27 has been divided into thirds, each third of the circumference being further divided into a small rotating angle $\theta_1$ and a large rotating angle $\theta_2$. However, the perimeter of head clutch plate 27 may be divided into any number of intergal divisions so long as $\theta_1$ plus $\theta_2$ equals 360°/N (where N is a positive integer). For example, the perimeter of head clutch plate 27 may be divided into four areas (N=4), and $\theta_1+\theta_2$ will equal 90° (360°/4).

When electromagnet 33 is energized, trigger lever 31 is rotated in a direction opposite to arrow C. Part 31*b* of trigger lever 31 disengages from projection 20*e* of paper feeding clutch plate 20. However, paper feeding clutch plate 20 does not rotate as switching lever 34 locks clutch plate 20 in place.

When thermal head 5 has been initially set away from platen sheet 45, as described above, carriage 4 must also be returned to its standby position (the left end in FIG. 1).

Reference is made to FIGS. 12A–E and 13 wherein the manner in which carriage 4 is returned to its standby position is depicted. A shifting lever 101 is rotatably fitted to case 1 on a shaft 1*d*. Shifting lever 101 has pins 101*a* and 101*b* at opposite ends thereof. One end of a spring 102 rests against pin 101*b*. The other end of spring 102 rests against case 1. Spring 102 biases shifting lever 101 to rotate in the direction indicated by arrow U (FIGS. 12A–E). Pin 101*a* is configured to engage worm 50 through an aperture 1*c* in case 1. The rotation of shifting lever 101 about shaft 1*d* is limited by the sides of aperture 1*c*. Case 1 has a series of shifting pins 1a set a distance $t_1$apart (hereafter referred to as the pitch). The length of aperture 1*c*, parallel to shifting pins 1*a*, is set so that when shifting lever 101 is rotated fully in the direction of arrow U the distance between pin 101*a* and the adjacent shifting pin 1*a* is equal to a multiple of the pitch of shifting pins 1*a* (i.e. $2t_1$, $3_{t1}$, $4_{t1}$, etc.). However, when shifting lever 101 is rotated in a direction opposite to arrow U, the distance between pin 101*a* and adjacent shifting pin 1*a* is not restricted.

Figure 12A:
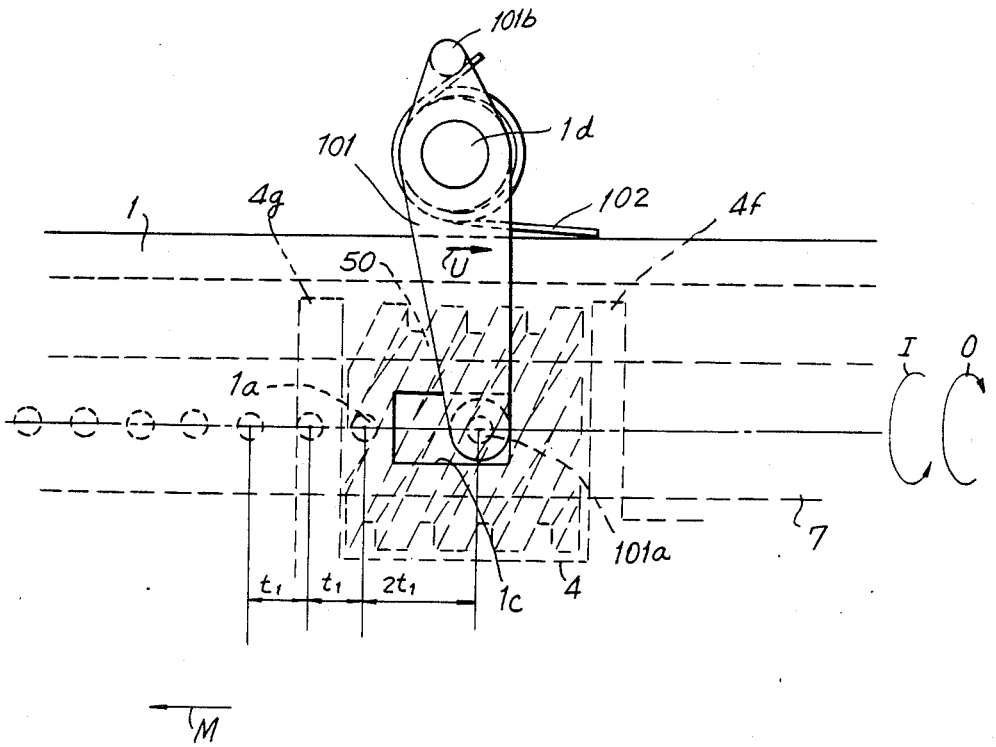
FIGS. 12A–E are expanded rear elevational views of circled area T of FIG. 1 in different relative positions.

When shifting pins 1*a* are engaged with helical groove 50*a* of worm 50 and shifting shaft 7 is rotated in the direction which occurs during paper feeding and returning, i.e. in the direction of arrow O, worm 50 is first moved towards the right, i.e. in the direction opposite to arrow M by virtue of the engagement between shifting pins 1*a* and helical groove 50*a* until worm 50 reaches the position shown in FIG. 12A. At this point groove 50*a* ceases to be in drive engagement with shifting pins 1a but is in drive engagement with pin 101*a* which is at the right hand end of aperture 1*c* (FIG. 12A).

When carriage 4 is moved rightwards in accordance with the engagement between worm 50 and shifting pins 1*a*, the slant face of groove 50*a* of worm 50 pushes against shifting pin 1*a* in the direction of arrow M and, due to reverse force, worm 50 and carriage 4 are moved in the direction opposite to arrow M.

The operation will now be described with reference to FIGS. 12A, 12B, 12C, 12D and 12E.

Figure 12B:
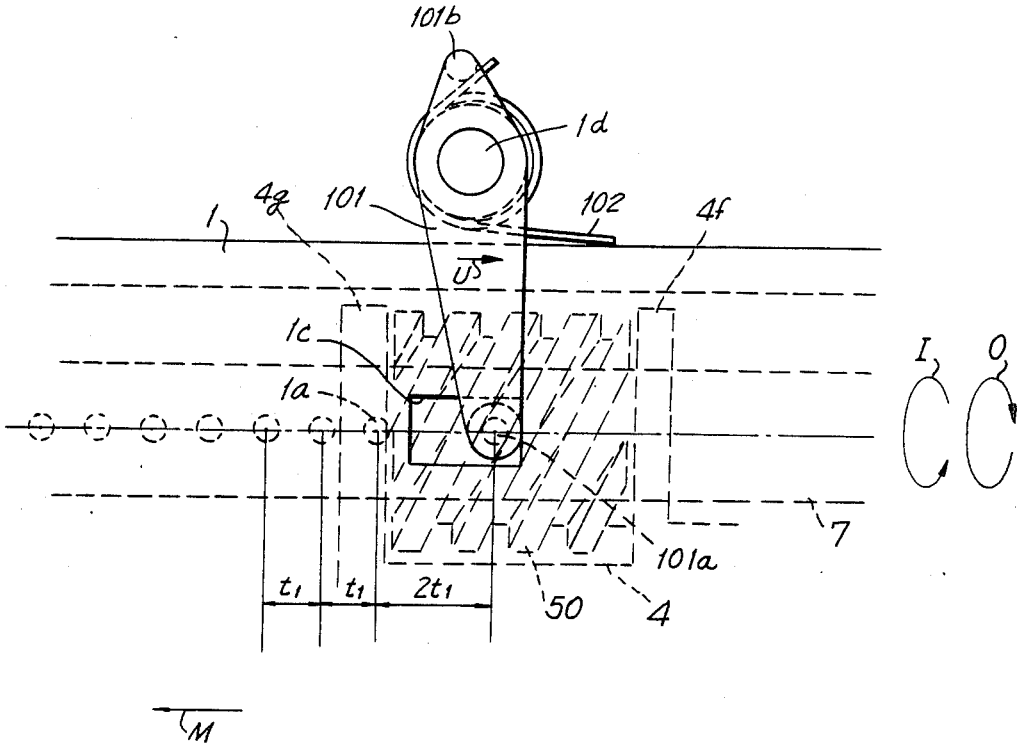
Figure 12C:
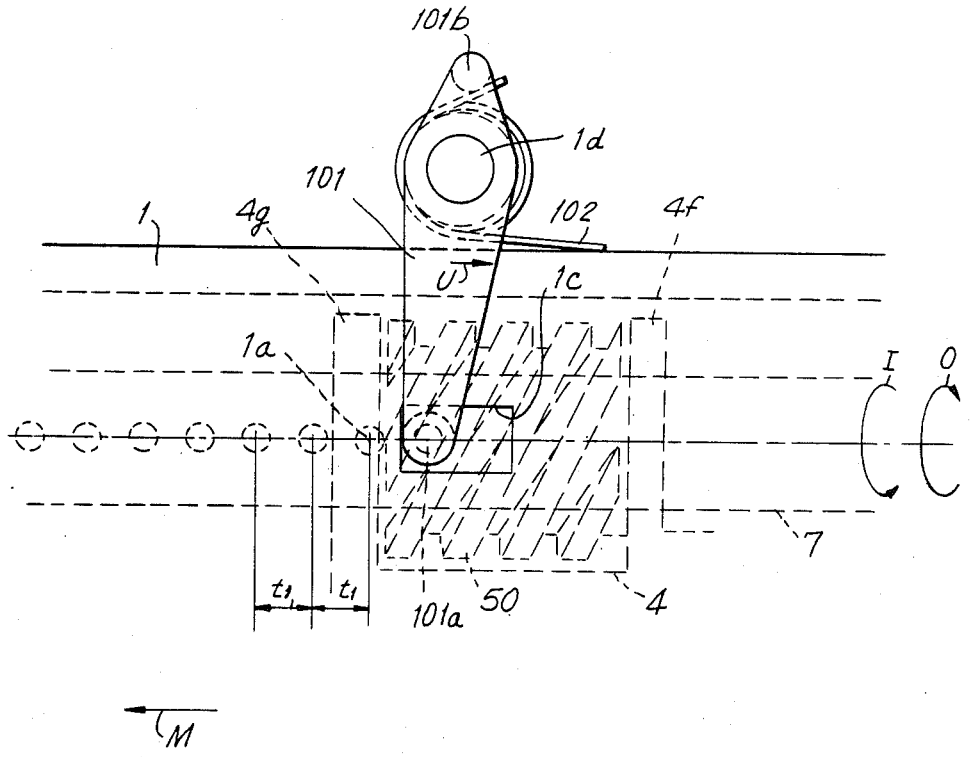

Assuming that worm 50 is rotated in the direction of arrow O, FIG. 12A shows the condition where worm 50 is about to be disengaged from the most right hand shifting pin 1*a*. When shifting shaft 7 is further rotated in the direction of arrow O, groove 50*a* of worm 50 is released from engagement with the most right hand shifting pin 1*a*, as shown in FIG. 12B. When shifting shaft 7 is still further rotated in the direction of arrow O, worm 50 cannot be moved further right towards the position shown in FIG. 12B, since the force of spring 102 for urging pin 101*a* in the direction of arrow U is smaller than the frictional load on carriage 4 in the direction of arrow M. Pin 101*a* is thus moved in the direction of arrow M by reason of its engagement in groove 50*a*. Then pin 101*a* abuts against the left hand end of aperture 1*c* and is thereby stopped. This state is shown in FIG. 12C.

Figure 12D:
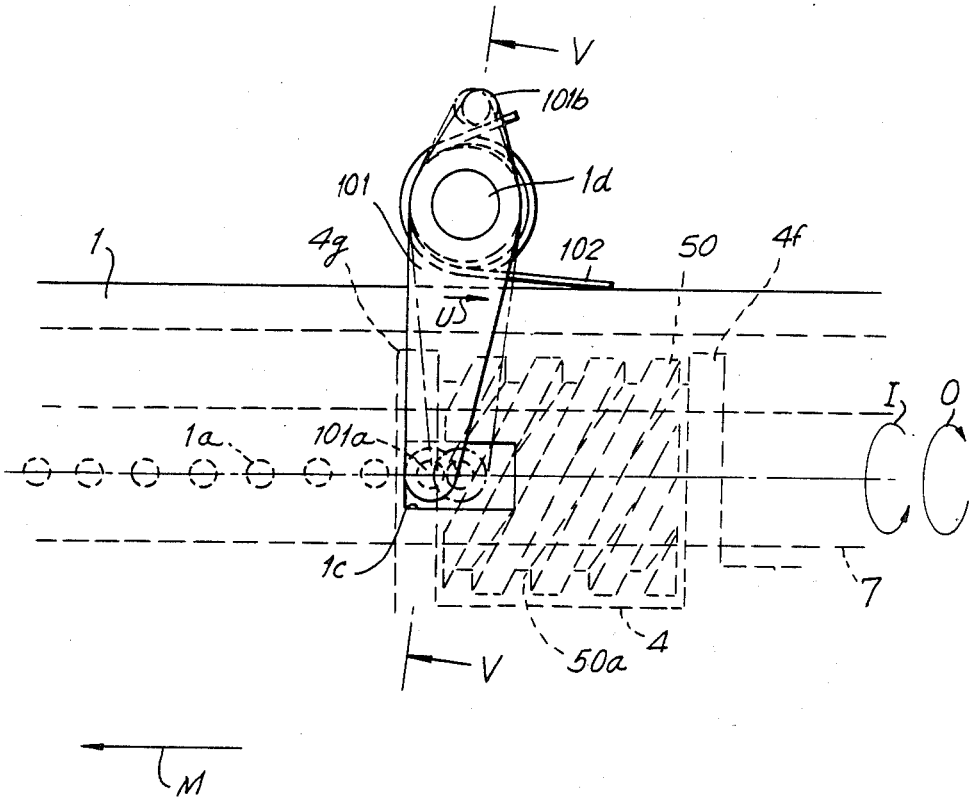
Figure 12E:
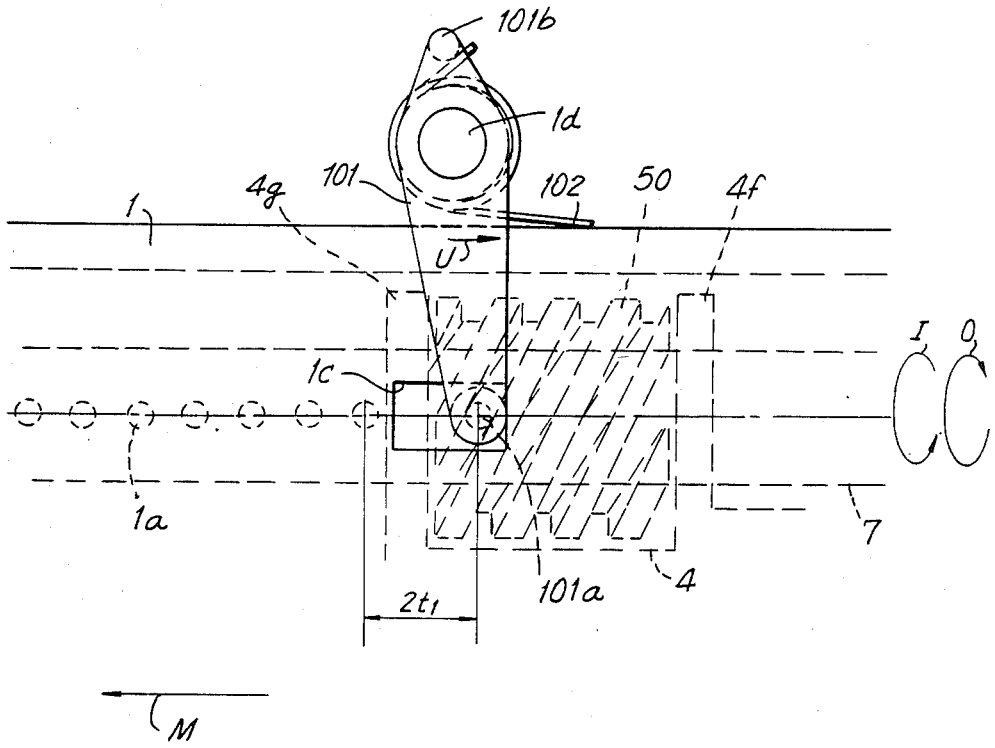
Figure 13:
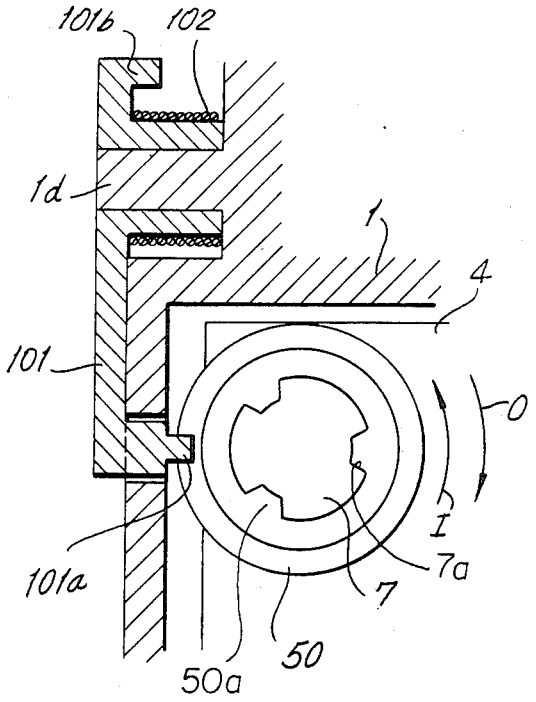
FIG. 13 is a cross-sectional view taken along line V—V of FIG. 12D.

When shifting shaft 7 is further rotated in the direction of arrow O, worm 50 is moved rightwards to the position shown in FIG. 12D, in which pin 101*a* is at the left hand end of helical groove 50*a*, due to the reverse force of pin 101*a*. Still further rotation of shifting shaft 7 merely allows pin 101*a* to reciprocate between the positions shown by the solid lines and the broken lines in FIG. 12D. Worm 50 is thus now in idle rotation.

In this way continuous paper feeding is easily achieved by rotation of shifting shaft 7 without effecting the position of carriage 4 and without any additional mechanism.

2. PRINTING

When motor 11 is rotated in the direction of arrow H shifting shaft 7 rotates in the direction of arrow I (FIG. 3). As a result, carriage 4 is moved in the direction of arrow M by worm 50, which is mounted on shifting shaft 7, interacting with shifting pins 1*a* (FIG. 9). At the start of the printing process thermal head 5 has been positioned in the non-printing position away from platen sheet 45 (FIG. 7). This position is established as a result of the initial setting procedures described above.

During the printing process, when shifting shaft 7 and worm gear 50 are both rotated in the direction of arrow I, spring 102 causes pin 101*a* to move along groove 50*a* in the direction of arrow U from the position shown in FIG. 12D to the right hand end of aperture 1*c*. In this state, the distance between pin 101*a* and the most right hand shifting pin 1*a* is equal to $2t_1$ or some other multiple of the pitch $t_1$ (see FIG. 12E).

Pin 101*a* abuts against the right hand end of aperture 1*c* and is thereby stopped. Due to the reverse force, worm 50 starts moving in the direction of arrow M. Worm 50 is moved to the position shown in FIG. 12A so that groove 50*a* of worm 50 is brought into engagement with fixed shifting pins 1*a*. Thereafter, worm 50 is further moved in the direction of arrow M.

Reference is made to FIGS. 7 and 8 wherein the manner in which head 5 is urged against platen sheet 45 is depicted. Thermal head 5 is in the non-printing position, away from platen sheet 45. As a result, surface 41*a* of head lever 41 urges head pushing rod 43 in the direction opposite to the direction of arrow F.

Reference is made to FIG. 9 wherein the effect of the movement of head pushing rod 43 in a direction opposite to the direction of arrow F is depicted. As pushing rod 43 moves in this direction, end 43*a* of pushing rod 43 pushes projection 48*a* of winding lever 48 downward, thereby causing winding lever 48 to rotate about shaft 4*h* of carriage 4 in the direction of arrow N. Winding lever 48 is biased by a spring 52 coupled at one end to a pin 4*i* and at the other end to a projection 48*c* of winding lever 48. Spring 52 biases projection 48*c* in the direction of arrow G.

As a result of the rotation of winding lever 48 in the direction of arrow N, winding gear 51 disengages from rack 1*b*. The engaged position of winding drive gear 51 and rack 1*b* is shown in solid lines in FIG. 9. The disengaged state is also shown in FIG. 9 with dotted lines. When winding drive gear 51 disengages from rack 1*b* thermal ribbon 6*a* is not wound even when carriage 4 moves.

When carriage 4 reaches a position where a character is to be printed on printing paper 49, electromagnet 33 is energized. Switching lever 34 is placed in the position shown in FIG. 4, as will be described later. The energization time of electromagnet 33 is set shorter than the rotation time of head clutch plate 27 to rotate through small rotating angle $\theta_1$. In particular, it is possible to rotate head clutch 30 one division at a time by allowing trigger lever 31 to re-engage head clutch plate 27 after part 31*a* disengages from projection 27*e* and before projection 27*f* rotates past projection 27*f*. Head clutch 30 is rotated in the direction of arrow K one step at a time each time electromagnet 33 is energized. As a result, head cam 42 rotates until it is in the position shown in FIG. 8, which causes thermal head 5 to press against platen sheet 45 making printing possible.

When thermal head 5 is energized while in the printing position (i.e., in contact with printing ribbon 6*a*, printing paper 49 and platen sheet 45), ink in thermal ribbon 6*a* is melted and transfers onto printing paper 49. This results in a character being printed on paper 49.

When thermal head 5 is in the printing position thermal ribbon 6*a* is wound. Head pushing rod 43 does not push projection 48*a* of winding lever 48 to cause rotation of winding lever 48 in the direction of arrow N about shaft 4*h*. Rather, the biasing force exerted by spring 52 in the direction of arrow G causes a rotation of winding lever 48 in a direction opposite to the direction of arrow N. This results in the engagement of winding drive gear 51 and rack 1*b*. As carriage 4 is moved in the direction of arrow M winding gear 53 and winding shaft 54 both rotate in the direction of arrow N causing thermal ribbon 6*a* to be wound. As long as characters or other indicia are to be printed carriage 4 continues to move in the direction of arrow M and thermal ribbon 6*a* is wound. If a series of blank, non-printing, spaces appear continuously on a line for which there is at least some printing, electromagnet 33 is energized so that head clutch 30 rotates one step and head cam 42 advances so as to achieve the position depicted in FIG. 7. In this position thermal head 5 is separated from platen sheet 45 and winding drive gear 51 remains disengaged from a rack 1*b*. As a result, carriage 4 continues to move but thermal ribbon 6*a* is not wound. If another character or indicia is to be printed electromagnet 33 is again energized causing head clutch 30 to rotate one step and thermal head 5 is pressed against platen sheet 45 to allow printing. At the end of the printing on each line, after the repetition of the above described operations, thermal head 5 is set in the non-printing position as shown in FIG. 7.

3. PAPER FEEDING AND CARRIAGE RETURNING

When the printing on a line has been completed the polarity of the energizing signal transmitted to motor 11 is reversed so as to cause motor 11 to rotate in the opposite direction (opposite to the direction of arrow H in FIG. 3). When motor 11 rotates in a backward direction, shifting gear 15, shifting shaft 7 and worm 50 also rotate in the reverse direction (the direction of arrow O - FIGS. 6, 12). The backward rotation of worm 50 causes carriage 4 to move in a direction opposite to the direction of arrow M, thereby returning to the standby carriage position.

Figure 6:
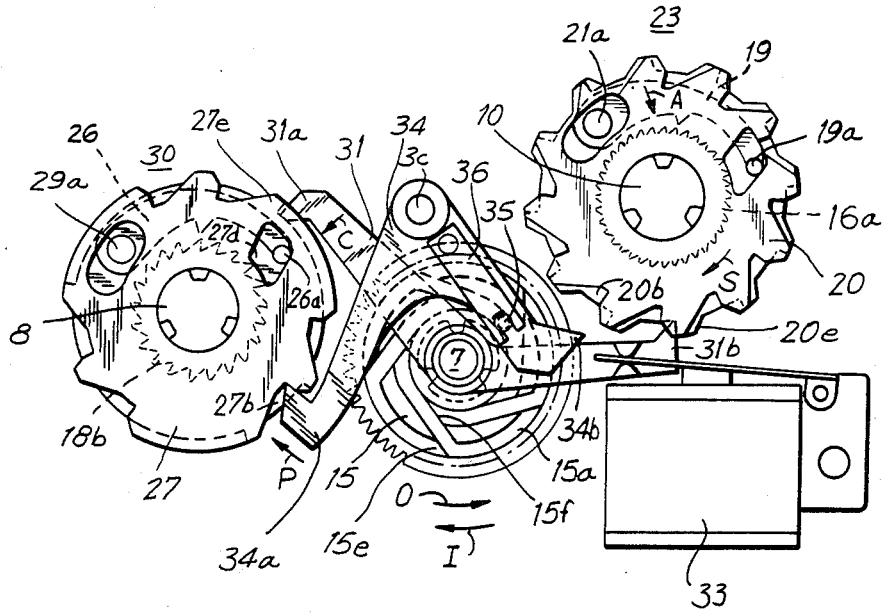
FIG. 6 is a side elevational view of the power transmission mechanism of FIG. 2 in a third state.

When shifting gear 15 rotates in the reverse direction (in the direction of arrow O), switching lever 34 rotates in the direction of arrow P, through switching pin 35 and step portion 15*e* of end face cam 15*a* (FIGS. 4, 11*a*). As a result, part 34*a* of switching lever 34 engages with cutout 27*b* of head clutch plate 27 locking head clutch plate 27 (FIG. 6). However, when switching lever 34 rotates as described, part 34*b* disengages from cutout 20*b* of paper feeding clutch plate 20. Therefore, when electromagnet 33 is energized, trigger lever 31 rotates in a direction opposite to arrow C (FIG. 4) so that parts 31*a* and 31*b* disengage from projection 27*e* of head clutch plate 27 and projection 20*e* of paper feeding clutch plate 20, respectively. However, head clutch plate 27 does not rotate because it is locked in place by switching lever 34*a*.

Paper feeding clutch plate 20, on the other hand, is unlocked and paper feeding pawl 19 rotates in the direction of arrow A (FIG. 4) as a result of the biasing effect of spring 22. Spring 22 biases gear 19*b* against paper feeding ratchet wheel 16a so that the rotation of paper feeding rachet wheel 16*a* in the direction of an arrow S (FIG. 6), is transmitted to paper feeding driving plate 21 through pin 21*a*. The rotation of paper feeding driving plate 21 is transmitted to paper feeding roller 46 (FIG. 7) through paper feeding transmission gears 70, 71, paper feeding gear 24, paper feeding knob 25 and paper feeding shaft 10 (FIG. 1), thereby feeding printing paper 49.

Electromagnet 33 is continually energized until printing paper 49 is fed a desired amount. When paper feeding is completed and carriage 4 has been returned to the standby position the motor is powered-off and the printer is ready to print a second line.

4. PRINTING AND PAPER FEEDING SUBSEQUENT TO THE FIRST PRINTED LINE

The polarity of the energization signal of motor 11 is again reversed so that motor 11 rotates in the direction of arrow H. This results in carriage 4 moving in the direction of arrow M. When motor 11 begins to rotate in the direction of arrow H, head clutch 30 is locked as shown in FIG. 6. However, as shifting gear 15 begins to rotate in the direction of arrow I, switching lever 34 rotates in a direction opposite to the direction of arrow P, through switching pin 35 and the stepped portion 15*f* of end face cam 15*a* (FIG. 6, 11*b*). As a result, paper feeding clutch 23 is locked in place and head clutch 30 becomes operable (FIG. 4). Thereafter, the printing process, paper feeding and carriage returning operate as described above.

Motor 11 has the polarity of the energizing signal reversed at the end of the printing on a line so as to intiate the return of carriage 4 to the standby position and to allow line feeding to occur as described above.

While the above invention has been described with respect to a thermal transfer printer the invention is not limited to thermal transfer printers but is applicable as well to other types of printers and to other types of apparatus in which power transmission is performed by using clutches.

Accordingly, a power transmission for use in a printer in which two clutches are independently controlled with the aid of a control and a locking member utilizing the forward and backward rotation of a motor with only a single electromagnetic member is provided. The most expensive portion of a printer and the one including the largest number of parts as well as occupying the largest space is an electromagnetic member. Therefore, by eliminating the need for an electromagnetic member reductions in cost, size and weight of the power transmission apparatus are achieved. As a result, as applied to a printer, a small, lightweight, inexpensive and portable printer can be produced.

In addition, a power transmission apparatus, constructed in accordance with the invention is provided with a clutch capable of setting the rotating angle less than one full rotation with an electromagnetic control member for controlling the clutch. The clutch is arranged so that the rotating angle of the clutch is divided into two parts, a small rotating angle and a large rotating angle. By energizing the electromagnetic control member for a period longer than the rotation time for the small rotating angle but shorter than the time for the large rotating angle the clutch will be initialized in a desired standby position. In particular, with the preselected energization time of the electromagnetic control member, the clutch is established in a standby position in which the print head is placed in the non-printing position in which the print head is away from the platen sheet.

Accordingly, with a power transmission constructed in accordance with the present invention it is always possible to stop the clutch at the desired position by utilizing the combination of the division of the rotating angle of the clutch and the variation in the energization time of the electromagnetic control member. This obviates the need for a detector to determine the position of the clutch. The detector is expensive, generally unreliable and its absence aids in the reduction of cost, size and weight of the power transmission apparatus while further improving its reliability. Therefore, a power transmission for use in a printer can be reduced in cost, size and weight so as to produce a practical, portable printer. The clutch initialization is often used in the printer to set the print head in a non-printing position at the start of printing a line or turn-on.

In addition, a printer in which the continuous rotation of the shifting shaft, even at the end of the movement range of the carriage, with low vibration, is provided. This is accomplished in a printer having a shifting cam member, moving jointly with a carriage, and provided with a lead on a worm on the outer surface thereof, due to interaction with a plurality of pin members provided at distances of equal pitch covering almost the entire range of movement of the carriage. The shifting shaft, rotatably mounted between the frames and which rotates with the shifting cam member, causes the carriage to reciprocate in response to the forward and backward rotation of the shifting shaft. A shifting auxiliary member at one end of the pin members has a pin extending outwardly therefrom parallel to the pin members. The shifting auxiliary member is biased away from the plurality of pin members. However, when the worm of the shifting cam members clears the plurality of pin members and the pin of the auxiliary shift member in a reverse direction the shifting shaft can continue to rotate without further movement of the carriage. However, as soon as the shaft reverses its direction of rotation, the pin in the shifting auxiliary member is taken up within the lead of the worm and the shifting cam member and carriage begin moving in the forward direction.

Accordingly, a printer in which the shifting shaft can be used to both move the carriage from left to right and right to left and cause line feeds to occur without large, cumbersome and noisy additional mechanism is provided. The combination of the shifting cam (worm), pin members and auxiliary shifting member allows the carriage to move to the end of its range and for rotation of the shifting shaft to continue. This allows for continuous line feeding without excessive vibration or additional components.

In addition, a thermal printer in which the thermal print ribbon is conserved by advance of the ribbon only when a character is to be printed is provided. The ribbon in the thermal printer is conserved with a simplified mechanism. The carriage moves between the frames in the movement range with the head cam member and has a thermal head mounted on the carriage. A head mounting member engages with the head cam member and a pushing member pushes the head mounting member to the platen sheet. A take-up driving member with a gear which is selectively engaged with a rack extends almost the entire width of movement of the carriage. When the thermal print head is in the non-printing position, away from the platen sheet, the pushing member rotates the gear away from the rack. However, when the head is in the printing position the gear engages with the rack, the thermal ribbon take-up member engages with the gear of the take-up member and the ribbon is advanced.

Accordingly, a printer with an efficient and compact thermal print ribbon is provided. The control of the take-up and the stopping of the ribbon are achieved by the rotation of the gear member without the need to move the entire carriage. Therefore, control of the ribbon with only a small force and a minimization of the working space required for the carriage is achieved. As a result, a compact and lightweight printer with low power consumption is provided.

It will thus be seen that the object set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrated and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A clutch controller for a power transmission, comprising:

a clutch rotatably mounted to the power transmission with a perimeter of the clutch divided into N equal rotating angles where N is a positive integer, each of said N equal rotating angles being further divided into two unequal rotating angles including a large rotating angle and a small rotating angle, the sum of the large rotating angle and the small rotating angle equalling one of said equal rotating angles, the perimeter of the clutch thereby being divided into 2N unequal rotating angles;

each of said large and small rotating angles defining a stopped position of said clutch;

controlling means, selectively coupled to the clutch for controlling the rotation of the clutch by selective engagement and disengagement of the controlling means and the perimeter of the clutch at the 2N unequal rotating angles;

electromagnetic control means, coupled to the controlling means, for decoupling the controlling means from the clutch, thereby allowing the clutch to rotate through an integral number of the unequal rotating angles, during an energization period and recoupling the controlling means with the clutch after the energization period, thereby preventing further rotation of the clutch; and output means, coupled to the clutch, having a first position and a second position; the electromagnetic control means establishing the output means in the second position when the electromagnetic control means is energized for a first period longer than the time for the clutch to rotate through the small rotating angle and shorter than the time for the clutch to rotate through the large rotating angle and the clutch is rotated from one unequal rotating angle to an adjacent unequal rotating angle when the electromagnetic control means is energized for a second period shorter than the time for the clutch to rotate through the small rotating angle.

2. A clutch initializer for a power transmission comprising:

a clutch rotatably mounted to the power transmission with the perimeter of the clutch divided into N equal rotating angles, where N is a positive integer, each of said N equal rotating angles being further divided into a large rotating angle and a small rotating angle, the sum of the large rotating angle and the small rotating angle equalling one of the equal rotating angles;

each of said large and small rotating angles defining a stopped position of said clutch;

controlling means, selectively coupled to the clutch for controlling the rotation of the clutch by the selective engagement and disengagement of the controlling means and the perimeter of the clutch at the 2N unequal rotating angles;

electromagnetic control means, coupled to the controlling means, for decoupling the controlling means from the clutch, thereby allowing the clutch to rotate through an integral number of the unequal rotating angles, during an energization period and recoupling the controlling means with the clutch after the energization period, thereby preventing further rotation of the clutch; and output means, coupled to the clutch, having a first position and a second position;

the electromagnetic control means establishing the output means in the second position when the electromagnetic control means is energized for a period longer than the time for the clutch to rotate through the small rotating angle and shorter than the time for the clutch to rotate through the large rotating angle and the clutch is rotated from one unequal rotating angle to an adjacent unequal rotating angle when the electromagnetic control means is energized for a second period shorter than the time for the clutch to rotate through the small rotating angle.

3. The clutch initializer of claim 2 wherein the perimeter of the clutch is divided into three equal rotating angles.

4. The clutch initializer of claim 2 wherein the controlling means comprises a rotatable member having a first and a second arm, said first arm being adapted to control the movement of the clutch and said second arm being adapted to control the movement of a second clutch.

5. The clutch initializer of claim 4 wherein the electromagnetic control means comprises an electromagnetic member with a pivotable plate.

6. The clutch initializer of claim 5 wherein the plate of the electromagnetic member is coupled to the first arm of the rotatable member.

7. The clutch initializer of claim 2 wherein the output means comprises a printer head and coupling means for coupling the printer head to the clutch, said printer head being movable between a first position and a second position.

8. The clutch initializer of claim 7 wherein the first position and the second position correspond to a printing position and a non-printing position.

9. The clutch initializer of claim 7 wherein the controlling means comprises a rotatable member having a first and a second arm, said first arm being adapted to control the movement of the clutch and said second arm being adapted to control the movement of a second clutch.

10. The clutch initializer of claim 9 wherein the electromagnetic control means comprises an electromagnetic member with a pivotable plate.

11. The clutch initializer of claim 10 wherein the plate of the electromagnetic member is coupled to the first arm of the rotatable member.

* * * * *